US005358537A

United States Patent [19]

Kelly et al.

[11] Patent Number: 5,358,537

[45] Date of Patent: Oct. 25, 1994

[54] PROCESS FOR DYEING POLYMERIC FIBERS

[75] Inventors: David R. Kelly, Dalton, Ga.; Richard Castle, Chatte, Tenn.; Christopher Bryant, Dalton, Ga.

[73] Assignee: Shaw Industries, Inc., Dalton, Ga.

[21] Appl. No.: 761,216

[22] Filed: Sep. 17, 1991

[51] Int. Cl.[5] ..... D06P 3/79; D06P 1/16; D06P 5/00

[52] U.S. Cl. ..... 8/483; 8/464; 8/470; 8/527; 8/528; 8/574; 8/611; 8/928; 8/929; /

[58] Field of Search ..... 8/527, 574, 609, 528, 8/464, 470, 928, 929, 483, 611, 528

[56] References Cited

U.S. PATENT DOCUMENTS

| | | | |
|---|---|---|---|
| 3,256,364 | 6/1966 | Bryant et al. | 8/552 |
| 3,926,547 | 12/1975 | O'Mahony et al. | 8/483 |
| 4,056,354 | 11/1977 | Pittman et al. | 8/533 |
| 4,073,615 | 2/1978 | Lacroix et al. | 8/578 |
| 4,311,481 | 1/1982 | Nelson | 8/564 |
| 4,762,522 | 8/1988 | Maue | 8/94.21 |
| 4,898,596 | 2/1990 | Riggins et al. | 8/490 |
| 4,981,488 | 1/1991 | Cates et al. | 8/574 |
| 5,092,904 | 3/1992 | Neely | 8/574 |
| 5,174,790 | 12/1992 | Rigging et al. | 8/490 |

OTHER PUBLICATIONS

*The Chemistry of Synthetic Dyes vol. III* edited by K. Venkatakman Academic Press N.Y. 1970* pp. 385–390 and 444–447.

Hackh's Chemical Dictionary, Fourth Edition, 1972*, p. 727: Xanthene.

E. R. Trotman's "Dyeing and Chemical Technology of Textile Fibres," (Wiley-Interscience) Sixth Edition, 1984*, pp. 485–488.

*Primary Examiner*—Linda Skaling

*Attorney, Agent, or Firm*—Willian Brinks Hofer Gilson & Lione

[57] ABSTRACT

There is disclosed a process and a composition for dyeing polymeric fibers which have limited dye sites and/or difficult to penetrate chemical structures. Briefly stated, the process comprises the steps of contacting polymeric fibers with a dye composition comprising a disperse dye and a swelling agent. The fibers in contact with said dye composition are then preferably heated to a temperature and for a time sufficient to effect dispersion of a portion of said dye into said polymeric fibers. Subsequently, the fibers are treated to remove residual dye composition.

34 Claims, No Drawings

PROCESS FOR DYEING POLYMERIC FIBERS

BACKGROUND OF THE INVENTION

The present invention relates to the field of dyeing. More particularly, the present invention relates to the field of dyeing polymeric fibers. Even more particularly, the invention relates to the field of dyeing polymeric fibers which have limited dye sites and/or difficult to penetrate chemical structures.

Polymeric fibers are used in a wide variety of applications. For example, fibers made from nylon can be formed into yarns that have wide application in textiles and carpets. One advantage of nylon is the fact that it is readily dyeable. In particular, the amine groups in the nylon polymer accept dye molecules known in the industry as acid dyes. The amine groups are thus "dye sites" for the nylon fibers. Techniques are known for dyeing nylon yarns wherein the complete yarn is dyed to a uniform color. In addition, techniques are know for space dyeing nylon yarn. In space dyeing, one or more colors of dye are applied at intermittent spaces along the length of the yarn. Space dyed nylon yarns are especially popular in carpet manufacture where they can provide a desired visual effect.

Techniques are also known for printing on fabrics or carpets made of nylon fibers. In particular, techniques are known for selectively placing one or more colors of dye on or in the fabric or carpet in a predetermined pattern.

In order to make nylon fibers stain resistant, techniques have been developed for blocking the dye sites on nylon fibers. In these techniques, the fibers are treated with a compound which blocks the amine groups on the nylon fibers to thereby make them unavailable as dye sites. As a result, stain molecules are prevented from attaching to the fibers, and the product can be promoted as stain resistant. This kind of treatment is particularly popular for nylon carpets. Specific examples of this treatment are known as WEAR-DATED by Monsanto, STAINMASTER by DuPont, and WORRY FREE by Allied.

Most stain resist treatments are presently added to the formed yarns or the carpet, and thus do not interfere with the dyeing of the fibers or yarns. However, some stain resist treatments, such as LUMINA by DuPont are included in the polymer melt. Thus, the pigment dyeing of such fibers will typically have to take place in the melt, thereby limiting the applicability of space dyeing or printing. In addition, if the stain resist treatment is applied to the yarn before tufting, the applicability of printing on the carpet is also limited.

The polyolefins, and particularly polypropylene, have experienced a growing popularity for use in fibers. The relatively low cost of polypropylene makes it especially attractive for carpets, upholstery fabrics, draperies and apparel fabrics.

One problem with using polypropylene is the fact that its structure is relatively inert and difficult to penetrate. The structure of polypropylene does not include dye sites. Consequently, the acid dyes typically used on nylon fibers could not generally be used to dye polypropylene.

One method of coloring polypropylene fibers is to use what is known as solution dyeing. In this process, the pigment is added directly to the polypropylene melt before the fibers are formed. A drawback of solution dyeing is that the fibers and yarns so produced all have the same color through their whole length. Naturally, solution dyeing cannot be used for space dyeing yarns or printing on fabrics or carpets.

Another method of coloring polypropylene fibers is to chemically modify the polymer with a chemical additive which will share electrons with a specially manufactured dye which contains a transition metal such as nickel, thus forming a coordination compound when heat is applied. This system is known as the nickel chelating system. Unfortunately, this system has the drawbacks of requiring a specially modified fiber, typically providing only dull metallic shades, and the production of water polluting effluents due to the presence of heavy metals.

SUMMARY OF THE INVENTION

Briefly stated, the present invention is a process and a composition for dyeing polymeric fibers which have limited dye sites and/or difficult to penetrate chemical structures. The process includes the steps of contacting such polymeric fibers with a dye composition including a disperse dye and a swelling agent. The fibers are left in contact with this dye composition for a time sufficient to effect dispersion of a portion of said dye into said polymeric fibers. Preferably, the fibers and dye composition are heated to a temperature at least above about 80° F. below the melting point of the polymeric fibers, which heating increases the rate of dispersion of the dye into the fibers. Subsequently, the fibers are treated to remove residual dye composition.

In accordance with the composition aspect of the invention, the dye composition includes a disperse dye, a swelling agent, and a thickener. Preferably, the dye composition further includes an amphoteric agent and an acid.

It is noted that the term "fibers" as used in this specification and the appended claims is intended to have a relatively broad meaning and to refer to fibers of all lengths and diameters. Specifically, what some refer to in the industry as "filaments" are also included within this definition. Also, the term "fibers" refers to the fibers whether they be separate fibers, formed into yarns, woven into fabrics, tufted into carpets, or formed into nonwoven fabrics.

It is noted that the phrase "polymeric fibers with limited dye sites" and similar phrases as used in this specification and the appended claims are intended to refer both to fibers which inherently have limited dye sites as well as to those which have been treated to reduce or block the inherent dye sites. In particular, the phrase includes fibers made of a polymer, such as polypropylene, which because of its chemical structure inherently has limited dye sites. In addition, the phrase includes fibers made from a polymer which have been treated to have its inherent dye sites blocked, for example nylon fibers which have been treated with a stain resist treatment.

It is also noted that the term "polymeric fibers with difficult to penetrate chemical structures" and similar phrases as used in this specification and the appended claims are intended to refer to fibers, such as polyester, which are substantially impenetrable to typical aqueous and non-aqueous dye solutions because they inherently have highly aligned crystalline structures.

In addition, it is noted that the verb "dye" as used in this specification and the appended claims is intended to have a relatively broad meaning and refer to the coloring of the polymeric fibers, and includes such applications of the dye composition to the fibers in spaced patterns that could be termed printing.

Also, it is noted that the term "disperse dye" as used in this specification and the appended claims is intended to refer to a class of dyes which do not contain molecular artionic or cationic charges and tend to disperse themselves in fibers.

Likewise, it is noted that the term "swelling agent" as used in this specification and the appended claims is also intended to have a relatively broad meaning and to refer to those compounds which affect at least a degree of swelling in the polymeric fibers.

Finally, unless stated to the contrary, all percentages provided herein are percentages by weight.

The method and composition of the present invention is advantageous in that a way is provided for dyelag fibers such as polypropylene which have limited dye sites and a difficult to penetrate chemical structure. Moreover, this object is accomplished without the use of the chelating systems mentioned above. Also, the present method has been found effective enough so that polypropylene yarns can be space dyed and carpets or fabrics made from polypropylene can be printed. Consequently, the invention allows polypropylene to be used with the same dyeing options as nylon fibers. In addition, the invention allows a carpet or fabric manufacturer to space dye or print yarns, fabrics, or carpets which have already had a stain resist treatment applied.

These and other advantages of the present invention will be better understood upon reading the following detailed description of the preferred embodiments, together with the examples below.

DETAILED DESCRIPTION OF THE PREFERRED EMBODIMENTS

As a first step in the method of the present invention, polymeric fibers are provided for dyeing. The fibers used in the present invention are polymeric fibers which have limited dye sites and/or difficult to penetrate chemical structures. As noted above, this class of fibers includes those fibers, such as polyolefins and polyesters, which inherently do not have dye sites as part of the polymer's structure.

This class also includes polymeric fibers which do inherently have dye sites on their structure, but have been treated to block or reduce the number of available dye sites. A common example of such a treatment is the stain resist treatment commonly used on the fibers in nylon carpets, such as STAINMASTER by DuPont. Such a stain resist treatment can be accomplished either after fiber formation or added to the polymer melt.

Preferably, the polymeric fibers used in the present invention are selected from the group consisting of nylon which has been treated to reduce available dye sites, polyolefins, and polyesters. More preferably, the fibers are made from a polyolefin. Most preferably, the fibers are made from polypropylene. A suitable polypropylene fiber is one such as that sold by Amoco under the designation 2600 denier polypropylene.

Alternatively, the fibers can be polyester. A suitable polyester is that sold by DuPont under the designation DACRON.

The polymeric fibers may be in different forms when dyed by the present method. For example, the polymeric fibers may be first formed into a yarn which is then dyed. Also, the polymeric fibers may be formed into a yarn which is woven into a fabric or tufted or fusion bonded into a carpet which fabric or carpet is then dyed. In addition, the fibers may be in the form of a nonwoven fabric, such as a spunbonded or meltblown web.

The fibers are contacted with a dye composition. The dye composition includes at least a disperse dye and a swelling agent.

The dye used in the present invention is a disperse dye. As noted above, a disperse dye is a dye which does not rely on chemical bonding to the substrate. Rather a disperse dye works by being dispersed within the substrate. Experiments have shown that dyes that contain ionic charges, such as acid dyes, premetalized dyes, catatonic dyes, direct dyes, and fiber reactive dyes, do not perform well in the present method or composition.

In general, the selection of the particular disperse dye or combination of dyes to be used with a particular fiber will depend on several factors. Naturally, the color desired will be most important. Together with that will be factors such as dye affinity, lightfastness and cost.

Typically, disperse dyes are categorized as low, medium or high energy depending on their molecular size and the amount of energy necessary to exhaust them on a fiber. Preferably, the disperse dyes are medium and high energy dyes, most preferably medium energy. Experiments have shown that, at least with polypropylene fibers, low energy disperse dyes have shown lower color yields.

Experiments have also shown that certain disperse dyes appear to have good affinity for polypropylene fibers, while other disperse dyes which have good affinity on other types of fibers have lower affinity on polypropylene. To date, this affinity does not appear to be correlated with the energy level of the disperse dye.

Another factor in the selection of the disperse dye to be used in the present invention is the lightfastness of the color within the fiber. Experiments have shown that some dyes which have a high affinity for polypropylene fibers have poor lightfastness, while some with lower affinity have good lightfastness.

At present, because all of the mechanisms for affinity and lightfastness are not completely understood, the best means for selecting the particular disperse dye or combination of dyes is by experimentation. TABLE 1 below lists disperse dyes which have shown favorable results in polypropylene fibers while TABLE 2 lists disperse dyes which have shown unfavorable results. The list in TABLE 1 is not to be taken as all inclusive, as other disperse dyes will perform suitably in the present invention.

TABLE 1

DYES SHOWING FAVORABLE RESULTS WITH POLYPROPYLENE

| DISPERSE DYE | Lightfastness 40 Hr. Xenon | CHARACTERISTICS |
|---|---|---|
| Disperse Yellow 54 200% | 3.7 | Med. energy, bright with reddish flare, good yield |
| Dispersol Yellow B-6G 200% | 3.5 | High energy, bright greenish yellow, excellent yield |
| Polychem Disperse Yellow 2SK | 3.3 | High energy, reddish yellow, good yield |
| Disperse Orange 25% | 4.0 | Med. energy, bright orange, good yield |
| Disperse Red 60 200% | 4.0 | Med. energy, bluish pink, excellent yield |
| Polychem Disperse Red FT | 4.0 | High energy, bright red, excellent yield |
| Disperol Brown C-3G 200 | 4.0 | High energy brown, good yield |

TABLE 1-continued

| DYES SHOWING FAVORABLE RESULTS WITH POLYPROPYLENE | | |
|---|---|---|
| DISPERSE DYE | Lightfastness 40 Hr. Xenon | CHARACTERISTICS |
| Polychem Disperse Violet RB | 4.0 | Medium energy violet, fair yield |
| Disperse Blue 56 | 2.8 | Medium energy blue, good yield |
| Terasil Blue BGE 200 | 4.5 | Medium energy, greenish blue, fair yield |
| Foursperse Black PR | 2.5 | Medium energy black, good yield |

TABLE 2

| DYES SHOWING LESS FAVORABLE RESULTS WITH POLYPROPYLENE | |
|---|---|
| DISPERSE DYE | UNFAVORABLE CHARACTERISTIC |
| Disperse Yellow 108 | poor yield |
| Disperse Yellow 211 | marginal lightfastness |
| Prosperse Yellow 10GF | poor lightfastness |
| Foron Brilliant Yellow S-7GL | poor lightfastness |
| Disperse Orange 37 | marginal lightfastness |
| Prosperse Brown PHL | marginal lightfastness |
| Disperse Red 1 | poor lightfastness |
| Disperse Red 50 | marginal lightfastness |
| Disperse Red 55 | marginal lightfastness |
| Disperse Red 82 | poor yield, poor lightfastness |
| Disperse Red 151 | poor lightfastness |
| Polychem Disperse Red R | poor lightfastness |
| Nylon Disperse Red LFB | poor lightfastness |
| Palanil Luminous Red G | poor lightfastness |
| Dispersol Green C-6G | poor lightfastness |
| Disperse Blue 7 | poor yield |
| Disperse Blue 26 | poor lightfastness |
| Disperse Blue 77 | poor lightfastness |
| Disperse Blue 165 | poor lightfastness |
| Disperse Blue 287 | poor lightfastness |
| Disperse Blue 337 | poor lightfastness |
| Celanthrene Fast Blue CR | poor yield |
| Foron Blue S-BGL | marginal lightfastness |
| Polychem Disperse Navy LF | poor lightfastness |
| Polychem Disperse Blue RL | poor lightfastness |
| Polychem Disperse Black TL | poor lightfastness |

As can be seen from these tables, there are several disperse dyes which have worked well with polypropylene, while there are also several disperse dyes which did not work well. Thus, at present, the selection of the specific dye or combinations of dyes to be used with a particular fiber is best made by experimentation, which experimentation is not undue and is clearly within the ordinary skill in the art to perform.

The dye composition of the present invention also includes a swelling agent. The term "swelling agent" refers to a compound or composition which is effective, when combined with the heating step, in opening up the structure of the polymeric fibers to thereby permit dispersion of the disperse dye within the fibers. Typically, the swelling agent includes a solvent in which the polymeric fibers have at least a degree of solubility at the heating temperature.

The swelling agent should have a boiling point and flash point above the temperature to which the fibers and dye composition will be heated. Preferably, the swelling agent will be odor free and not present any health or safety problems in handling. Naturally, the swelling agent is selected so as to be economical. TABLE 3 below lists various swelling agents which have been evaluated. All of the swelling agents tested showed some degree of effectiveness. Other swelling agents which perform the desired function are also acceptable and are thus within the context of the present invention.

TABLE 3

| EVALUATION OF SWELLING AGENTS | |
|---|---|
| SWELLING AGENT | CHARACTERISTICS |
| N-cyclohexyl-2-pyrrolidone | Outstanding Performance, but high cost |
| SWELLING AGENT D - 85 parts diethylene glycol, 10 parts N-cyclohexyl-2-pyrrolidone, 5 parts Wacogen NH600N (wetter and compatibilizer) | good performance, low cost |
| N-n-octyl-2-pyrrolidone | good performance, but high cost and odor |
| Diethylene glycol (DEG) | good performance |
| Benzaldehyde | odor |
| Acetophenone | odor |
| Butyl Benzoate (Cindye DAC-888) | odor |
| monochlorotoluene (Lancara) | odor |
| Cindye DAC-999 (blend of esters) | odor |
| 2-ethyl hexanol | odor and emulsification |
| biphenyl | odor |

Of the listed swelling agents, the Swelling Agent D, i.e. the blend of diethylene glycol, N-cyclohexyl-2-pyrrolidone is most preferred. The Wacogen NH600N is a wetter and compatibilizer which can be purchased from Waco Chemical Co., Dalton, Ga. Preferably, the diethylene glycol is present in an amount between about 50 and about 85 percent, the n-cyclohexyl-2-pyrrolidone is present in an amount between about 10 and about 50 percent. Most preferably, the diethylene glycol is present at about 85% and the n-cyclohexyl-2-pyrrolidone is present at 10%.

A swelling agent comprising 100% N-cyclohexyl-2-pyrrolidone performed very well. However, it is less preferred because of its high cost. Diethylene glycol by itself also performed satisfactorily for many applications.

Preferably, the swelling agent is also put together with a wetting agent, sometimes referred to as a dye compatibilizer. Most preferably, the wetting agent is an amphoteric compound such as that sold by Waco Chemical under the designation Wacogen NH600N.

Preferably, the dye composition also includes a thickener to impart a relatively high viscosity to the composition. Especially when used for space dyeing or printing, the dye composition is preferably in the form of a paste so as to allow for the most selective placement of the composition on the yarn, fabric or carpet.

Experiments have shown that viscosities between about 800 and about 3000 cps are preferred. Naturally, the particular viscosity selected will depend on the method of applying the dye composition to the yarn, fabric or carpet. Higher viscosities are typically used for printing polypropylene woven or knitted fabrics.

A wide variety of thickeners may be used in the dye composition. Preferably, the thickener is selected from the group consisting of guar gum, gum arabic, modified cellulose, locust bean gum, and synthetic gums such as xanthene as well as combinations thereof. Most preferably, the thickener is guar gum.

The amount of thickener used will depend on the particular thickener chosen as well as the desired viscosity. If the thickener is the preferred guar gum, the amount of thickener is preferably between about 0.5 and about 2.0 percent. More preferably, the amount of guar gum is between about 0.7 and about 1.2 percent. The amount of thickener used and the viscosity obtained will depend on the nature of the yarns or fabric to be dyed or printed and the method used.

The preferred pH of the dye composition will depend on the polymeric fiber being dyed, and the particular disperse dye and swelling agent being used. When dyeing polypropylene and using the disperse dyes and swelling agents discussed above, the pH of the dye composition is preferably adjusted between about 2 and about 4. More preferably, the pH is adjusted between about 2.5 and about 3.0. Most preferably, the pH is about 2.8.

Various acids can be used to adjust the pH of the dye composition. Preferably, the acid is selected from the group consisting of formic, acetic and sulfamic acid. Most preferably, the acid is formic added at about 2% of the dye composition.

Preferably, the dye composition also includes an amphoteric agent, which helps to reduce the effect of molecular charges within the composition. Various amphoteric agents are known for this use. Wacogen NH600N from Waco Chemical and Chemcogen 132-N from Rhone-Poulene, Inc. are suitable for this purpose.

The most preferred method of putting the dye composition together is as follows. A print paste is made up by adding to water the following: 7–12 g/l of guar gum, 1 g/l of the amphoteric agent, and 10 g/l of the Swelling Agent D. The desired disperse dyes are first dispersed in hot water with 1 g/l of Polyassist DDL, and then added to the paste with agitation. Polyassist DDL is a dispersing agent which helps disperse the dye in the hot water. Polyassist can be obtained from Polychem, Ltd. under the designation Polyassist DDL and is generally comprised of ligno-sulfonate and solvent. Then 2% formic acid is added and the paste is mixed until the gum is hydrolyzed and the desired viscosity is obtained.

The dye composition can be applied to the polymeric fibers in various ways. Preferably, the fibers are in the form of a yarn which is space dyed. That is, the dye composition is applied intermittently along the length of the yarn to thereby create a desired effect. Various techniques are known for applying a dye to a yarn in this fashion. For example, U.S. Pat. No. 3,926,547 shows an acceptable system.

Another preferred method is that known by the term "knit-deknit" dyeing. In this method, the fibers are formed into a yarn which is in turn knit, typically into a tubing. The dye composition is then intermittently applied to the knit tubing. After dyeing, the tubing is unraveled and the yarn thus has an intermittent pattern as desired. An example of this knit-deknit system is described in U.S. Pat. No. 4,047,405.

Yet another preferred method of applying the dye composition to the fibers is to print on fabric or carpets made from the fibers. That is, the fibers are first formed into yarn and which is then woven or knitted into fabric or tufted into carpet. Various method of printing on fabric or carpet are known in the art. For example, the printing machine such as that sold by Peter Zimmer, Inc. under the name "flat screen printer" is satisfactory for applying the dye composition according to the present invention.

Once the dye composition is applied, the fibers and dye composition are left in contact with each other for a predetermined time sufficient to effect dispersion of a portion of the disperse dye into the polymeric fibers.

Preferably, the fibers and dye composition are heated during contact. This step is referred to as heat fixation of the dye. The temperature and the time are selected so as to effect dispersion of a portion of the disperse dye into the fibers.

The temperature and time are inversely related. That is, when a higher temperature is used, a shorter time can generally be used. When a lower temperature is used, a longer time should generally be used in order to allow for sufficient dispersion of the dye within the fibers. The specific temperatures and time will depend on several factors. The melting point of the fiber being used should be considered. Preferably, the temperature for the heating step is at least above about 80° F. below the melting point of the polymeric fibers. It has been found that a temperature that is above the melting point is optimum. For example, polypropylene fibers which have a melting point of about 329° F., are preferably heated above about 280° F., and most preferably heated to a temperature of about 350° F., or about 21° F. above the melting point of the fibers. Preferably, the temperature will be above about 280° F., more preferably between about 340° and about 360° F., and most preferably about 350° F.

Preferably, the time will be between about 5 seconds and about 12 minutes, more preferably between about 15 seconds and about 2 minutes, most preferably about 1 minute. The time and temperature are also dependent on the form and density of the article being dyed. For warp yarns at 350° F., 5 to 15 seconds required time will be sufficient. For knit tubing the required time will be about 2 minutes. For dense tufted carpet, fixation may require 6 to 12 minutes.

Dry heat or atmospheric steaming or a combination of the two can be used to effect dye fixation. Although dry heat is preferred, atmospheric steaming has shown good results when good to high yield dyes are employed. If atmospheric steaming is used, the temperature will be about 212° F. and the time will preferably be between about 3 and about 20 minutes, most preferably about 12 minutes.

The manner of heating the fibers and dye composition can be effected by various means. Preferably, the heat is supplied by a radiant means, such as passing the fibers near to heat elements or through a preheated oven. Alternatively, the heat can be supplied by heated rolls, radio frequency or microwaves, or superheated steam.

In accordance with an alternative embodiment, the heat is first applied to a temperature and for a time sufficient to drive off excess water from the dye composition before the heat fixation step.

After the heat fixation step, the fibers are treated to remove any residual dye composition. This can be done by conventional means. Preferably, the fibers are first washed with a detergent and are then rinsed with water. Preferably, the detergent is one selected from the group consisting of Mariasol SB-4, Textile Scour #2, Proscour NX, and combinations thereof.

While not wishing to be bound by any particular theory, it is currently believed that the dyeing process of the present invention employs a mechanism that can be described as follows. It is believed that the combination of the disperse dye, the swelling agent, and the time and/or heat work together so that the disperse dyes are able to become dispersed within the polymeric fibers during the fixation step. It is also believed that, upon cooling, at least a portion of the disperse dye molecules become physically entrappeal with the fibers.

It is noted that, while this theory appears to be consistent with the remarkable results achieved when practicing the process of the present invention, the theory is provided by way of explanation only and should not be seen to be limiting the scope of the appended claims.

EXAMPLES

The following examples are provided by way of illustration and explanation and as such are not to be viewed as limiting the scope of the present invention.

Example 1 was carried out by first forming a print paste with the following composition:

Print Paste A 10 g/l Guar Gum (Galaxy 1084)
20 g/l Swelling Agent D
2% Formic Acid added to a pH of 2.7
1 g/l Polyassist DDL (A dispersing agent to help the dyes disperse)
5 g/l Dispersol Yellow B-6G 200
0.5 g/l Polychem Disperse Red FT
20 g/l Disperse Blue 56

This paste was mixed in the following manner: The gum and swelling agent are added to cold water and agitated. The dyes are dispersed in hot water with Polyassist DDL. The dye dispersion is added to the gum and swelling agent and water is added to the desired volume. The acid is added while the paste is being agitated, until the desired viscosity is obtained.

The paste was then printed on a section of 1450 denier polypropylene knit tubing which had been solution dyed to a light beige shade.

The knit tubing was then dried at about 250° F. for about 5 minutes to dry off free water.

Next, the knit tubing was heat fixed in an oven set at 345° F. for 2 minutes.

Following the heat fixation, the knit tubing was afterscoured in a high pH reduction bath containing 4 g/l Mariasol SB-4 (Lenmar Chemical Co., Dalton Ga.) and 2.5 g/l Textile Scour #2 (Waco Chemical Co., Dalton Ga.) at 120° F. for 1 minute. The knit tubing was then rinsed in water at 120° F. for 1 minute.

After drying at 250° for 4 minutes, the areas of the knit tubing that were printed with the paste were dyed to a clear dark green shade.

Examples 2, 3 and 4 were carried out by making the following print pastes B, C and D:

Print Paste B 5 g/l Guar Gum (707D Galaxy)
20 g/l Swelling Agent D
1 g/l Chemcogen 132-N
2% Formic Acid to a pH of 2.5–3.0
0.5 g/l Polyassist DDL (added to dyestuff)
8 g/l Disperse Blue 56

Print Paste C 5 g/l Guar Gum (707D Galaxy)
20 g/l Swelling Agent D
1 g/l Wacogen NH600N
2% Formic Acid to a pH of 2.5–3.0
0.5 g/l Polyassist DDL (Added to dyestuff)
3 g/l Polychem Disperse Red FT Print Paste D 5 g/l Guar Gum (707D Galaxy)
15 g/l N-cyclohexyl-2-pyrrolidone
1 g/l Chemcogen 132-N
2% Formic Acid to a pH of 2.5–3.0
0.5 g/l Polyassist DDL (Added to Dyestuff)
0.5 g/l Dispersol Yellow B-66 200
3.0 g/l Disperse Yellow 54 200%
8.0 g/l Disperse Blue 56
3 g/l Polychem Disperse Red FT Each of these print pastes were printed on a piece of 30 oz. polypropylene carpet which has been solution dyed to a light gray shade. The printing was accomplished on a Zimmer flatbed laboratory print machine. Paste B was printed through the first screen in a small flower configuration. Paste C was printed through the second screen in an alternative small flower configuration. Paste D was printed through the third screen in a connecting leave and stem configuration. After printing, the carpet was cut into three equal sized samples.

For Example 2, the printed carpet section was steamed at 212° F. for 15 minutes.

For Example 3, the printed carpet section was first steamed at 212° F. for 15 minutes and then heat fixed in a laboratory oven at 345° F. for 12 minutes. It was found that, owing to the density of carpet, the sample required a longer fixation time than yarn.

For Example 4, the printed carpet section was heat fixed in a laboratory oven at 345° F. for 12 minutes.

After the heat treatments described above, the carpet sections were afterscoured in a reduction bath and then rinsed as in Example 1. The sections were dried at 225° F. for 8 minutes.

Each carpet section resulted in a clear print with a green stem with red and blue flowers running through the gray background shade. The carpet section of Example 3 showed considerably better color yield than Example 2. Example 4 showed better color yield than Example 3.

Examples 5 and 6 were conducted with print pastes E and F which were similar to print paste A of Example 1 except that print paste E contained 10 g/l Disperse Blue 56 and print paste F contained 3 g/l Disperse Red 60 200%.

A single end of 1450 denier polypropylene yarn which had been solution dyed to a beige base shade was run through a conventional warp print space dye machine and alternatively sprayed with print paste E and F.

In Example 5, the single end of the sprayed yarn was passed 2 inches under a radiating heat electrode at 360° F. for an exposure time of 5 seconds.

In Example 6, the single end of the dye sprayed yarn was passed through a Zimmer Strayfield radio frequency oven with a kilovolt setting of 9.0 for 3 minutes.

Both samples were afterscoured in the bath of Example 1 at 120° F. for 30 seconds and rinsed clean at 120° F. The samples were then dried at 225° F. for about 2 minutes.

The yarns of Examples 5 and 6 were dyed to clear alternating medium pink and blue shade on the beige background shade.

Examples 7 and 8 were conducted with print pastes G and H made as follows:

Print Paste G 7 g/l Guar Gum (Galaxy 1084)
15 g/l N-cyclohexyl-2-pyrrolidone
1 g/l Wacogen NH600N
2% Acetic Acid added to a pH of 3.5
0.5 g/l Polyassist DDL
3 g/l Polychem Disperse Red FT Print Paste H 7 g/l Guar Gum (Galaxy 1084)
15 g/l N-cyclohexyl-2-pyrrolidone
1 g/l Wacogen NH600N
2% Acetic Acid added to a pH of 3.5
0.5 g/l Polyassist DDL
15 g/l Terasil Black CM #2 paste Two samples of 2.25/2 polyester yarn were alternatively sprayed with paste G and paste H to about 100% wet pick up.

In Example 7, one sample of the sprayed polyester yarn was steamed for 7.5 minutes at 212° F.

In Example 8, another sample of the sprayed polyester yarn was heat fixed in an oven for 30 seconds at 350° F.

Both samples were afterscoured, rinsed and dried as in Examples 5 and 6.

The yarn of Example 7 showed a black and pink shade. The red dye had apparently migrated in the steamer to produce long spaces of pink and short spaces of black.

The yarn of Example 8 showed a clean and sharp black and pink yarn with no apparent dye migration.

Examples 9 and 10 were conducted with print paste I made as follows:

Print Paste I 7 g/l Guar Gum (Galaxy 1084)
15 g/l N-cyclohexyl-2-pyrrolidone
1 g/l Wacogen NH600N
2% Acetic Acid added to a pH of 3.5
0.5 g/l Polyassist DDL
5 g/l Disperse Blue 73

The dye paste was applied intermittently to a skein of Monsanto solution-dyed nylon yarn which had previously been produced in a medium gray shade by its manufacturer.

In Example 9, one section of the skein was steamed at 212° F. for 7.5 minutes.

In Example 10, another section of the skein was placed in an oven with circulated dry heat at 350° F. for 45 seconds.

Both skeins were afterscoured, rinsed and dried as in Examples 5 and 6 above.

Both skeins showed a clear blue intermittent color on the gray background Monsanto solution-dyed nylon.

Examples 11–15 were conducted to study the shrinkage of polypropylene knit tubing as a function of the time at the heat fixation temperature. Sections of 1450 denier polypropylene knit tubing were obtained and subjected to 340° F. for the following times with the noted shrinkage in the width of the tubing:

| Example No. | Time at T° (minutes) | Width of Tubing (inches) | % shrinkage |
|---|---|---|---|
| Greige Goods | 0 | 4.375 | — |
| 11 | 1 | 4.25 | 2.86 |
| 12 | 2 | 3.875 | 11.43 |
| 13 | 2.5 | 3.5625 | 18.57 |
| 14 | 3 | 3.4375 | 21.43 |
| 15 | 3.5 | 3.125 | 28.57 |

In this study, the dye was found to be only about 50% fixed after 1 minute at heat fixation temperature. After 2 minutes at temperature, the dye was about 90% fixed. Exposure longer than 2 minutes does not appear to justify the additional shrinkage. Consequently, a heat fixation time of about 2 minutes is most preferred for polypropylene knit tubing fixed at 340° F.

Example 16 was conducted with a sample of Amoco polypropylene shag carpet which has been solution dyed to a beige shade. The following two print pastes were prepared:

Print Paste J (Orange)

9 g/l Galaxy 1084 Gum
20 g/l n-octyl-2-pyrrolidone
1 g/l Wacogen NH600N
2% Formic Acid (added last)
3 g/l Disperse yellow 54 200%
1 g/l Disperse red 60 200%

Print Paste K (Green)

9 g/l Galaxy 1084 Gum
20 g/l n-octyl-2-pyrrolidone
1 Wacogen NH600N
2% Formic Acid (added last)
2 g/l Disperse yellow 54 200%
10 g/l Disperse blue 56

The two print pastes were prepared as discussed above. The viscosity of each print paste was about 2000 cps and the pH about 2.8. Each print paste was applied to the carpet on a Zimmer Laboratory print machine using alternating but not overlapping screens.

The printed carpet was steamed for 15 minutes in a laboratory steamer. The carpet was then placed in an oven which has been preset at 250° F. for a period of 20 minutes.

The carpet was then afterwashed in a bath containing 3 g/l textile scour #2 at 120° F. for 45 seconds.

The carpet was then dried at 250° F. The dried carpet showed a medium orange and green patterned coloration.

It is thus seen, that a novel process and dyeing composition for dyeing polymeric fibers with limited dye sites and/or difficult to penetrate chemical structures has been disclosed.

What is claimed is:

1. A process for printing or space dyeing polyolefin fibers to produce discrete dyed and undyed regions comprising the steps of:

providing polyolefin fibers, which polyolefin fibers have limited or no dye sites as part of the polymeric structure;

contacting said polyolefin fibers at intermittent regions with a dye composition comprising a disperse dye and a swelling agent;

applying dry heat to said polyolefin fibers in contact with said dye composition at a temperature at least above about 80° F. less than the melting point of the polyolefin fibers for a time sufficient to effect dispersion of a portion of said disperse dye into said polyolefin fibers;

removing residual dye composition from said polyolefin fibers.

2. The process of claim 1 wherein the temperature is above about 280° F.

3. The process of claim 1 wherein the time is above about 15 seconds.

4. The process of claim 1 wherein the time is between about 15 seconds and about 12 minutes.

5. The process of claim 1 wherein the time is about 2 minutes.

6. The process of claim 1 wherein the polyolefin fibers are in the form of a yarn.

7. The process of claim 6 wherein the yarn is space dyed by contacting the yarn at intermittent spaces along its length with the dye composition.

8. The process of claim 6 wherein the yarn is space dyed with more than one color of dye by alternating contact of the yarn with a dye composition including the dye of each color.

9. The process of claim 6 wherein the yarn has been knit before being contacted by the dye composition and wherein the yarn is deknitted after being contacted by the dye composition to thereby create a space dyeing effect along the length of the yarn.

10. The process of claim 6 wherein the yarn is tufted into a carpet which is then printed by applying the dye composition in a predetermined pattern to produce dyed and undyed regions in the carpet.

11. The process of claim 10 wherein more than one color dye is applied in a predetermined pattern on the carpet.

12. The process of claim 1 wherein the polypropylene fibers are in the form of a woven or knitted fabric.

13. The process of claim 1 wherein the swelling agent comprises a major ingredient selected from the group consisting of n-cyclohexyl-2-pyrrolidone, diethylene glycol, and n-n-octyl-2-pyrrolidone.

14. The process of claim 1 wherein the swelling agent comprises a mixture of n-cyclohexyl-2-pyrrolidone and diethylene glycol.

15. The process of claim 14 wherein the swelling agent comprises between about 10 and about 50 percent n-cyclohexyl-2-pyrrolidone and between about 50 and about 85 percent diethylene glycol.

16. The process of claim 14 wherein the swelling agent comprises between about 30 and about 50 percent n-cyclohexyl-2-pyrrolidone and between about 50 and about 70 percent diethylene glycol.

17. The process of claim 1 wherein the dye composition further comprises a thickener and wherein the viscosity of the dye composition is between about 800 and about 3000 centipoise at 80° F. as measured by a Brookfield Viscosimeter with a No. 3 spindle.

18. The process of claim 17 wherein the thickener is selected from the group consisting of guar gum, locust bean gum, modified cellulose, xanthene gum and combinations thereof.

19. The process of claim 17 wherein the thickener is present in an amount between about 0.5 and about 2 percent.

20. The process of claim 1 wherein the dye composition further comprises an amphoteric agent which reduces the effect of molecular charges within the dye composition.

21. The process of claim 1 wherein the pH of the dye composition is between about 2 and about 4.

22. The process of claim 21 wherein the pH of the dye composition is adjusted by addition of an acid selected from the group consisting of acetic, citric, formic, and sulfamic acid as well as combinations thereof.

23. The process of claim 1 wherein the residual dye composition is removed from the polypropylene fibers by washing the fibers in a detergent followed by a water rinse.

24. A process for printing or space dyeing polypropylene fibers to produce discrete dyed and undyed regions comprising the steps of:

providing polypropylene fibers;

contacting said fibers at intermittent regions with a dye paste comprising a disperse dye, a swelling agent, a thickener, and an acid;

applying dry heat to said fibers in contact with said dye composition at a temperature above about 280° F. for at least about 15 seconds to thereby effect dispersion of a portion of said dye into said fibers; and washing said fibers to remove residual dye composition.

25. The process of claim 24 wherein the swelling agent comprises a major ingredient selected from the group consisting of n-cyclohexyl-2-pyrrolidone diethylene glycol, and n-n-octyl-2-pyrrolidone.

26. The process of claim 24 wherein the time is about 1 minute.

27. The process of claim 24 wherein the temperature is below about 360° F.

28. A process for dyeing polypropylene fibers comprising the steps of:

providing polypropylene fibers;

contacting said fibers with a dye paste comprising a disperse dye, a swelling agent, a thickener, and an acid, the dye paste having a viscosity between about 800 and about 3000 centipoise at 80° F. as measured by a Brookfield Viscosimeter with a No. 3 spindle;

heating said fibers in contact with said dye paste at a temperature above about 280° F. for at least about 15 seconds to thereby effect dispersion of a portion of said dye into said fibers; and washing said fibers to remove residual dye paste.

29. The process of claim 28 wherein the polypropylene fibers are in the form of a yarn and the yarn is space dyed by contacting the yarn at intermittent spaces along its length with the dye paste.

30. The process of claim 28 wherein the polypropylene fibers are in the form of a yarn which is tufted into a carpet to which the dye paste is applied in a predetermined pattern to thereby create a printed pattern on the carpet.

31. The process of claim 28 wherein the polypropylene fibers are in the form of a yarn which is woven into a fabric to which the dye paste is applied in a predetermined pattern to thereby create a printed pattern on the fabric.

32. A process for dyeing polyolefin fibers comprising the steps of:

providing polyolefin fibers, which polyolefin fibers have limited or no dye sites as part of the polymeric structure;

contacting said polyolefin fibers with a dye composition comprising a disperse dye and a swelling agent comprising a mixture of n-cyclohexyl-2-pyrrolidone and diethylene glycol;

applying dry heat to said polyolefin fibers in contact with said dye composition at a temperature at least above about 80° F. less than the melting point of the polyolefin fibers for a time sufficient to effect dispersion of a portion of said disperse dye into said polyolefin fibers;

removing residual dye composition from said polyolefin fibers.

33. The method of claim 32 wherein the swelling agent comprises between about 10 and about 50 percent n-cyclohexyl-2-pyrrolidone and between about 50 and about 85 percent diethylene glycol.

34. The method of claim 32 wherein the swelling agent comprises between about 30 and about 50 percent n-cyclohexyl-2-pyrrolidone and between about 50 and about 70 percent diethylene glycol.

* * * * *

UNITED STATES PATENT AND TRADEMARK OFFICE

CERTIFICATE OF CORRECTION

PATENT NO. : 5,358,537
DATED : October 25, 1994
INVENTOR(S) : David R. Kelly et al.

It is certified that error appears in the above-indentified patent and that said Letters Patent is hereby corrected as shown below:

On the Title Page

In column 1, line 10 under "References Cited U.S. PATENT DOCUMENTS", delete "Rigging" and substitute --Riggins--.

In column 2, line 2 under "OTHER PUBLICATIONS", delete "Venkatakman" and substitute --Venkatarman--.

Signed and Sealed this

Twenty-sixth Day of September, 1995

*Attest:*

Bruce Lehman

BRUCE LEHMAN

*Attesting Officer*

*Commissioner of Patents and Trademarks*